US012722675B2

(12) United States Patent
Patel

(10) Patent No.: US 12,722,675 B2
(45) Date of Patent: Sep. 1, 2026

(54) RAILROAD CROSSING WARNING SYSTEM FOR ENHANCED ROUTE PLANNING BASED ON SPECTROGRAM ANALYSIS

(71) Applicant: Meet Patel, Happy Valley, OR (US)

(72) Inventor: Meet Patel, Happy Valley, OR (US)

( * ) Notice: Subject to any disclaimer, the term of this patent is extended or adjusted under 35 U.S.C. 154(b) by 826 days.

(21) Appl. No.: 18/093,347

(22) Filed: Jan. 5, 2023

(65) Prior Publication Data

US 2024/0227889 A1 Jul. 11, 2024

(51) Int. Cl.
*B61L 29/30* (2006.01)
*B61L 29/24* (2006.01)

(52) U.S. Cl.
CPC ..... *B61L 29/30* (2013.01); *B61L 29/243* (2013.01); *B61L 29/246* (2013.01)

(58) Field of Classification Search
CPC ..... B61L 29/08; B61L 29/18; B61L 29/22; B61L 29/24; B61L 29/243; B61L 29/246; B61L 29/28; B61L 29/284; B61L 29/30
USPC ..... 246/473.1
See application file for complete search history.

(56) References Cited

U.S. PATENT DOCUMENTS

2018/0222506 A1* 8/2018 Kranz ..... B61L 29/224

FOREIGN PATENT DOCUMENTS

WO WO-2017207830 A1 * 12/2017 ..... B61L 29/28

* cited by examiner

*Primary Examiner* — S. Joseph Morano
*Assistant Examiner* — Heaven R Buffington
(74) *Attorney, Agent, or Firm* — Cochran Legal, LLC; Colin Cochran, Esq.

(57) ABSTRACT

A system for detection of trains at railroad crossings is provided comprising a field-deployed detection and reporting device. The device comprises a microphone, a communication module, a microprocessor, an application executing on the microprocessor. The application receives periodically generated samples of ambient sound captured by the microphone and performs Fast Fourier Transformation on data associated with the generated samples. The application also creates a spectrogram based on the output of the performed Fast Fourier Transformation, analyzes components of the spectrogram using at least a proprietary algorithm, and transmits, based on the analysis, a first message via the communication module. The device is situated proximate a railroad crossing. The ambient sound is generated by a warning bell sounded at the railroad crossing. The warning bell is sounded to indicate presence of a railroad train.

22 Claims, 3 Drawing Sheets

RAILROAD CROSSING WARNING SYSTEM FOR ENHANCED ROUTE PLANNING BASED ON SPECTROGRAM ANALYSIS

CROSS REFERENCE TO RELATED APPLICATIONS

None

FIELD OF THE INVENTION

The present disclosure is in the field of railroad transportation. More particularly, the present disclosure provides systems and methods of detecting sounds associated with warning bells at railroad crossings that indicate passing trains and based thereon advising nearby motorists via wireless notification of potential for traffic congestion and delay.

BACKGROUND

Railroad transportation, for moving both passengers and freight, are essential to the economic and social well-being of developed countries. Freight trains transport a major portion of US goods daily. This has inadvertently led to problems with blocked railroad crossings, for extensive periods of time in many cases. Railroads used by the freight industry often travel through urban areas and cause extensive automobile traffic delays due to their length and slower speeds. Freight trains could stretch up to three miles and are operated at very low speeds through residential areas. The issues of railroad crossing safety and traffic congestion have reached high levels of the US federal government but have failed to receive action. Further, there have been documented cases of delayed emergency responses.

Although advanced route planning technology is available, such technology does not provide information relating to the state of railroad crossings. This information is not shared by railroad operators. Rail companies have state-of-the-art monitoring systems that are not available for public or city municipality use.

Previous implementations describe devices using laser or vibration to detect incoming trains and may require cooperation of the railroad involved including using components owned by the rail company. No previous implementation independently identifies the state of a crossing.

Most railroad crossings now have protection in the form of automatic warning devices such as flashing lights, warning sounds, and barriers or gates. Crossing gates and electronic bells are activated simultaneously before the arrival of the train and stay active for several minutes after the train has passed. But the problem of automobile traffic congestion caused by long and slow freight trains remains.

DETAILED DESCRIPTION

Figure 1:
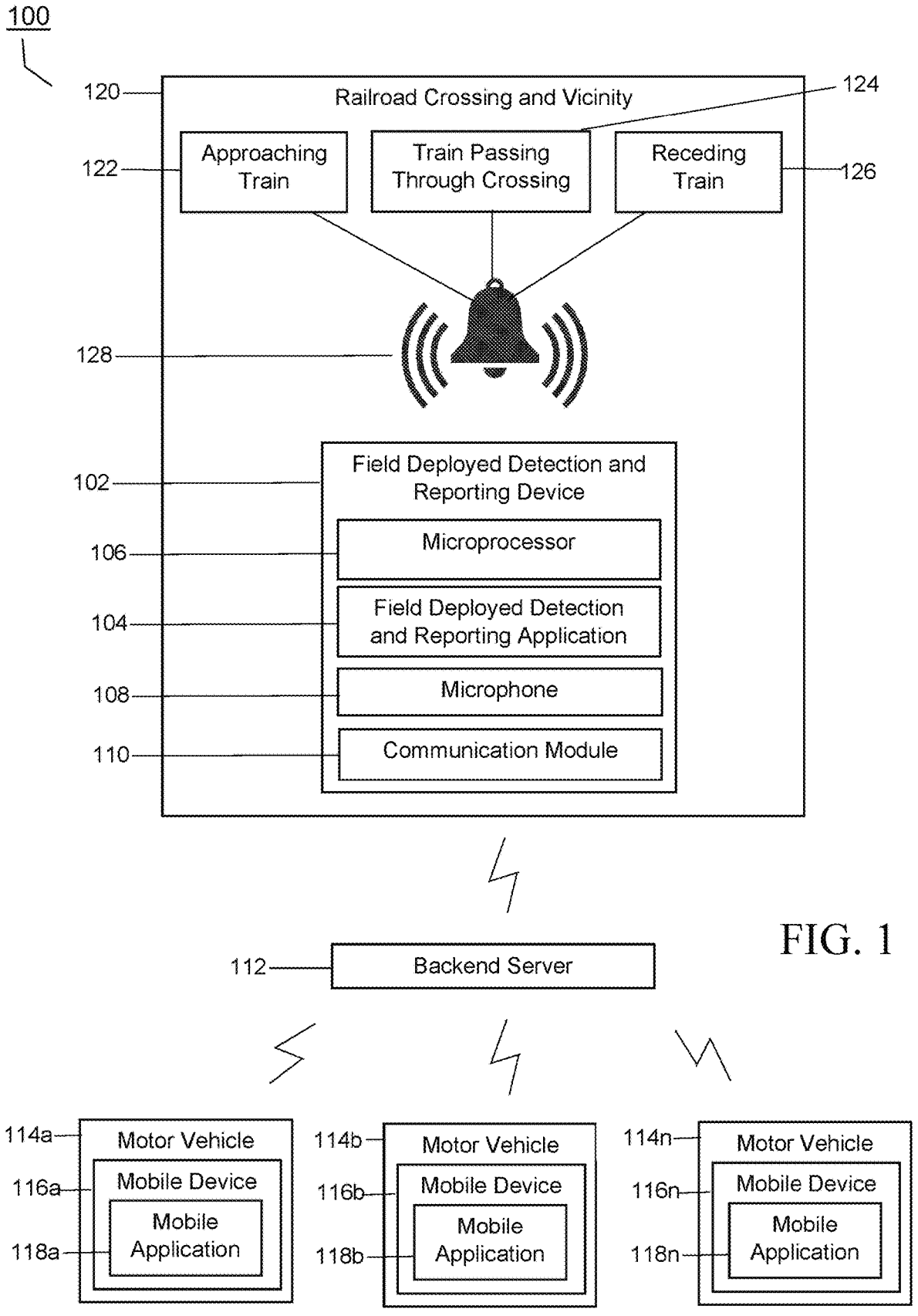
FIG. 1 is a block diagram of a railroad crossing warning system for enhanced route planning according to an embodiment of the present disclosure.

Systems and methods described herein provide for observing the open or closed state of a railroad crossing and making that information available to motor vehicle operators and others in near real time via a mobile application. Ambient sound is captured, converted into frequencies and then depicted or plotted as a spectrogram. The spectrogram is analyzed in its entirety to detect specific sound patterns by a proprietary algorithm. The algorithm was developed by capturing hundreds of hours of sound samples to train a neural network. It was trained to a point where it could detect bell sounds with 99% or higher accuracy. Electronic bells that are typically mounted on masts supporting gates or tall poles near crossings are activated by the railroad as a train is approaching. Systems provided herein are programmed to detect when the electronic bell begins and stops sounding.

Systems and methods of the present disclosure have two primary objectives: 1) Quickly and accurately determine the state of railroad crossing gate, either open or closed; and 2) Communicate with the mobile application in proximate and distant vehicles as quickly as possible.

As a train approaches a crossing, the crossing gate closes and the bell begins to sound. Electronic bells used by railroads have an array of frequencies. A device that may be referred to as the Field-Device (FD) is deployed in the vicinity of a crossing and listens continuously using a digital or an analog microphone. The surrounding noise is captured and processed by a microprocessor that may be dual core and an application executing thereon. When the bell begins alarming such that a train is approaching, an algorithm or formula mentioned previously is activated by the application. The algorithm or formula detects the specific sound patterns on the spectrogram and orders a communication module to update status of the crossing to "closed" in a mobile application executing on motorist devices. The same algorithm also detects when the bell has stopped alarming to indicate reopening of the crossing. The microprocessor then orders the communication module to send updates to motorists' devices changing the crossing status to "open".

The application, including at the least one algorithm, periodically samples ambient sound, for example every 3 seconds using an analog or a digital mic (I2S protocol), performs the appropriate version of the Fast Fourier Transform on the incoming data to create a spectrogram. The components of the spectrogram are then analyzed by a proprietary algorithm developed using the neural network and machine learning. This analysis of the spectrogram ensures accurate and fast detection of the state of the gate.

The device provided herein is equipped with a solar panel that powers all components of an Integrated Circuit (IC) when optimal sunlight is available. The solar panel also charges the onboard Lithium-ion battery during the optimal sunlight hours. The Li-ion battery provides power when the solar panel cannot provide power. The device is energy independent. Power needs of systems provided herein may be met by the structure described above and may reduce or eliminate a need for maintenance.

The lightweight design and small footprint of the device allows it to be mounted conveniently in the vicinity of railroad crossing. The device is not in most embodiments mounted on any of the active components of the railroad system owned by the railroad company.

Other than listening for sounds emitted by the bell at crossings, systems and methods provided herein do not control or take input from any railroad crossing components or other components controlled by the railroad. Further, no action or participation by the railroad is required or involved. The device provided herein which contains the microprocessor, microphone, and cellular module may be mounted, for example, on a street sign, on a sign board, or on a residential awning in the vicinity of the railroad crossing. The detection and warning methods provided herein are fully independent of the railroad.

The field deployed detection and reporting device contains the microphone. The device also contains the microprocessor and the communication module.

The device may share data with local public transportation authorities. Buses equipped with GPS functionality may use functionality provided to reduce delays and improve rider experience. First responders' response time may be greatly improved by having this information in advance. Rideshare organizations such as Lyft and Uber may also benefit from systems and methods provided herein.

In an embodiment, a network of interconnected field devices such as that provided herein may be built. Existing backend server functionalities to determine crossing status when one of the devices in the chain malfunctions may be used. The data gathered by such device network can also be used to train a Neural Network which, when used in conjunction with the Artificial Intelligence (AI), will open numerous possibilities to either directly improve the system described here or provide add-on services in the future.

As part of getting information from the point-of-action to the end user, a mobile application was developed. With its user-friendly interface, it shows the state of the gate with color coded rings. These rings are superimposed onto the map of the area of focus. The overall system is designed to expand the capability nationwide. The app can be updated to include time approximation as data becomes available post deployment.

Turning to the figures, FIG. 1 is a diagram of a system of gate tracking as provided herein. FIG. 1 illustrates components and interactions of a system 100 of railroad crossing warning for enhanced route planning.

The system 100 comprises a field deployed detection and reporting device 102 and a field deployed detection and reporting application 104 executing thereon, referred to hereafter for brevity as the device 102 and the application 104, respectively. The application 104 includes at least one algorithm that is not shown in FIG. 1.

The system 100 also includes a microprocessor 106, a microphone 108, and a communication module 110 which in some embodiments may be referred to as a cellular module. The system 100 further includes a backend server 112, motor vehicles 114*a-n*, mobile devices 116*a-n*, and mobile applications 118*a-n*. The mobile applications 118*a-n* execute on the mobile devices 116*a-n* which are carried in motor vehicles 114*a-n* that may travel near railroad crossings and be subject to delays by passing trains. Mobile devices 116*a-n* may be associated with drivers or other users participating in a subscription program to receive notifications and other services described herein provided by the system 100. In some embodiments, those subscribing mobile devices 116*a-n* may be identified as "selected" or otherwise "associated with" the deployed detection and reporting device 102 and a field deployed detection and reporting application 104.

Also illustrated for discussion purposes in FIG. 1 but not directly provided by the system 100 are a railroad crossing and vicinity 120 which may be referred to for brevity as the crossing 120, an approaching train 122, a train passing through crossing 124, a receding train 126, and a warning bell 128, all components provided by a railroad company in most embodiments.

As approaching trains 122, trains passing through crossing 124, and receding trains 126, i.e., trains leaving the crossing 120, are in effect at a crossing 120, the warning bell 128 is sounded by the railroad company to warn motorists. A barrier may also be lowered to physically obstruct vehicles from crossing tracks. The microphone 108 is receiving and passing along sounds of the warning bell 128 and all other proximate sounds to the microprocessor 106. The application 104, as noted, samples ambient sound periodically, performs Fast Fourier Transform on the captured data to create a spectrogram. The spectrogram is then algorithmically analyzed for data suggesting approaching of a railroad train. As described in greater detail above, as long as the results of the analysis meets criteria contained in the application 104, the device 102, via the cellular module 110, notifies the backend server 112 which transmits messages to the mobile applications 118*a-n*. Motorists and others who have downloaded the mobile application 118*a-n* on their phones have this information readily available when the application is launched. Availability of information as well as notifications provided by the mobile application 118*a-n* is not dependent on users' geographic location. Components in FIG. 2 and FIG. 3 are indexed to components provided by the system 100.

Figure 2:
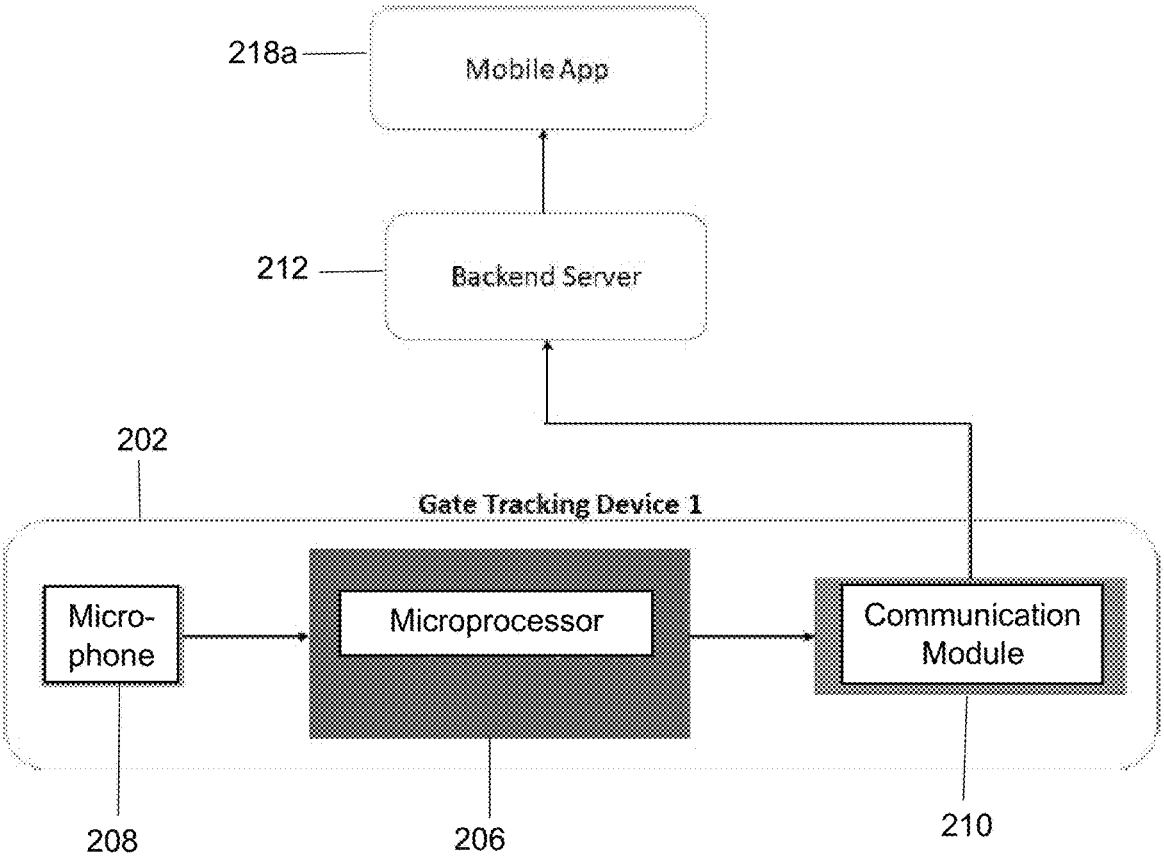
FIG. 2 is a flow diagram of a railroad crossing warning system for enhanced route planning according to an embodiment of the present disclosure.

FIG. 2 shows communication between the device 202 and backend server 212 supporting the mobile application 218*a*. The software interactions between the components are illustrated in FIG. 2, particularly the software configuration of the backend server 212. What is depicted is equivalent to the communication module 110 provided by the system 100. FIG. 2 additionally shows an exemplary mobile application or app 218*a*, an exemplary microprocessor 206, an exemplary microphone 208, and an exemplary communication module or module 210.

Figure 3:
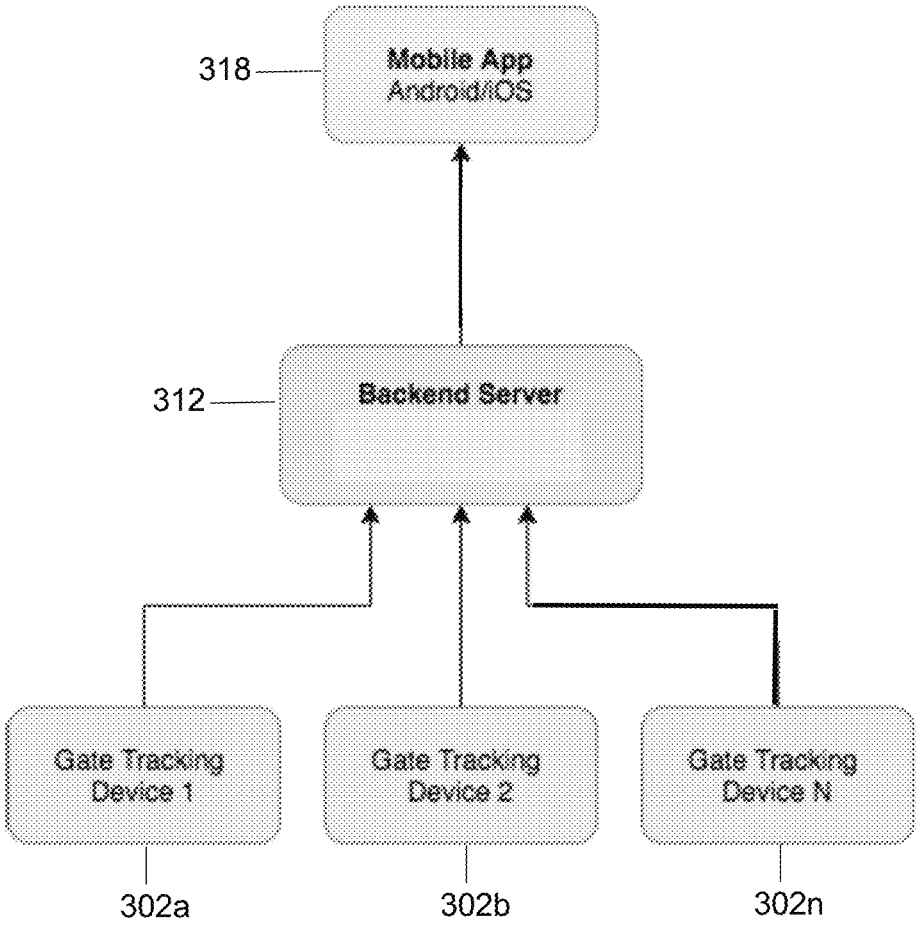
FIG. 3 is a flow diagram of a railroad crossing warning system for enhanced route planning according to an embodiment of the present disclosure.

FIG. 3 illustrates multiple devices 302, shown as Gate Tracking Devices, transmitting through the backend server 312 to mobile applications 318. In embodiments, a single backend server 312 can receive messaging from a plurality of devices 302. If these devices 302 are located at railroad crossings on the same rail line in geographical succession, their reported information may be used in determining if a railroad train has stopped, its direction, or if one of the devices 302 has malfunctioned.

In an embodiment, a system for detection of trains at railroad crossings is provided comprising a field-deployed detection and reporting device. The device comprises a microphone, a communication module, a microprocessor, an application executing on the microprocessor. The application receives periodically generated samples of ambient sound captured by the microphone and performs Fast Fourier Transformation on data associated with the generated samples. The application also creates a spectrogram based on the output of the performed Fast Fourier Transformation, analyzes components of the spectrogram using at least a proprietary algorithm, and transmits, based on the analysis, a first message via the communication module.

The device is situated proximate a railroad crossing. The ambient sound is generated by a warning bell sounded at the railroad crossing.

The warning bell is sounded to indicate presence of a railroad train. The first message is received by a backend server that issues a first broadcast based on receipt of the first message.

The broadcast is directed to selected wireless devices and warns at least of temporary closing of the railroad crossing. The application further determines that the ambient sound associated with the warning bell discontinues.

Based on the determination, the application sends a second message via the module to the backend server. Based on receipt of the second message, the backend server issues a second broadcast, the second broadcast indicating that the railroad crossing is reopened.

In another embodiment, a system for reducing vehicle traffic delays at railroad crossings is provided. The system comprises a computer and an application executing on the computer that processes a series of sounds received by a microphone proximate the computer. The application also performs Fast Fourier Transform (FFT) analysis on data associated with the sampled ambient sounds. The application also creates and analyzes, via a proprietary algorithm, a spectrogram based on the data. The application also instructs a server, via a cellular module and based on the analysis, to transmit a broadcast.

The computer is situated proximate a railroad crossing. The sampled ambient sounds are generated by an alarm bell at the railroad crossing.

The analysis of at least the spectrogram indicates that a railroad train is approaching the crossing. The broadcast is directed to selected wireless devices.

In yet another embodiment, a method of reducing vehicle traffic delays at railroad crossings is provided. The method comprises a computer equipped with a communication module receiving from a proximate microphone a plurality of electronic signals representing ambient sounds captured by the microphone. The method also comprises the computer, based on performance of a fast Fourier transform on data associated with the captured sounds, creating a spectrogram representing the data. The method also comprises the computer, based on analysis of the spectrogram by at least one proprietary algorithm, transmitting via the module a first message to a backend server.

The method also comprises the backend server issuing a broadcast to wireless devices associated with the computer. The method also comprises the computer, based on the analysis, determining that the ambient sounds indicate a railroad train is present at a railroad crossing proximate the microphone.

The ambient sounds are associated with a warning bell situated at the railroad crossing. The method also comprises the broadcast warning the wireless devices of a closed status of the railroad crossing. The method also comprises the computer subsequently transmitting via the module a second message to the backend server, the second message advising of an open status of the railroad crossing, the second message based on continued analysis of ambient sounds proximate captured by the microphone.

What is claimed is:

1. A system for detection of trains at railroad crossings, comprising:
- a field-deployed detection and reporting device comprising:
  - a microphone;
  - a communication module;
  - a microprocessor; and
  - an application executable on the microprocessor, wherein the application is configured to:
    - receive periodically generated samples of ambient sound captured by the microphone,
    - perform Fast Fourier Transformation on data associated with the generated samples,
    - create a spectrogram based on the output of the performed Fast Fourier Transformation,
    - analyze components of the spectrogram, and
    - transmit, based on the analysis, a first message via the communication module.

2. The system of claim 1, wherein the device is situated proximate a railroad crossing.

3. The system of claim 2, wherein the ambient sound is generated by a warning bell sounded at the railroad crossing.

4. The system of claim 3, wherein the warning bell is sounded to indicate presence of a railroad train.

5. The system of claim 4, wherein the first message is received by a backend server that issues a first broadcast based on receipt of the first message.

6. The system of claim 5, wherein the first broadcast is directed to selected wireless devices and warns at least of temporary closing of the railroad crossing.

7. The system of claim 6, wherein the application further determines that the ambient sound associated with the warning bell discontinues.

8. The system of claim 7, wherein based on the determination, the application sends a second message via the communication module to the backend server.

9. The system of claim 8, wherein based on receipt of the second message, the backend server issues a second broadcast, the second broadcast indicating that the railroad crossing is reopened.

10. A system for reducing vehicle traffic delays at railroad crossings, comprising:
- a computer; and
- an application on the computer, wherein the application is configured to:
  - process a series of sounds received by a microphone proximate the computer,
  - perform Fast Fourier Transform (FFT) analysis on data associated with the series of sounds,
  - create and analyze, a spectrogram based on the data, and
  - instruct a server, via a cellular module and based on the analysis, to transmit a broadcast.

11. The system of claim 10, wherein the computer is situated proximate a railroad crossing.

12. The system of claim 11, wherein the series of sounds are generated by an alarm bell at the railroad crossing.

13. The system of claim 12, wherein the analysis of at least the spectrogram indicates that a railroad train is approaching the crossing.

14. The system of claim 10, wherein the broadcast is directed to selected wireless devices.

15. A method of reducing vehicle traffic delays at railroad crossings, comprising:
- a computer equipped with a communication module receiving from a proximate microphone a plurality of electronic signals representing ambient sounds captured by the microphone;
- the computer, based on performance of a fast Fourier transform on data associated with the captured sounds, creating a spectrogram representing the data; and
- the computer, based on analysis of the spectrogram, transmitting via the communication module a first message to a backend server.

16. The method of claim 15, further comprising the backend server issuing a broadcast to wireless devices associated with the computer.

17. The method of claim 16, further comprising the broadcast warning the wireless devices of a closed status of a railroad crossing.

18. The method of claim 15, further comprising the computer, based on the analysis, determining that the ambient sounds indicate a railroad train is present at a railroad crossing proximate the microphone.

19. The method of claim 15, wherein the ambient sounds are associated with a warning bell situated at a railroad crossing.

20. The method of claim 15, further comprising the computer subsequently transmitting via the communication module a second message to the backend server, the second message advising of an open status of the railroad crossing, the second message based on continued analysis of ambient sounds captured by the proximate microphone.

21. An apparatus for detection of trains at railroad crossings, comprising:

a field-deployed detection and reporting device comprising:

a microphone;

a communication module;

a microprocessor; and an application executable on the microprocessor wherein the device is configured to receive a series of ambient sounds captured by the microphone, perform fast Fourier transformation on data associated with each sound of the series of sounds, generate a spectrogram based on the output of the performed fast Fourier transformation of each sound of the series of sounds, analyze the spectrogram, and transmit, based on the analysis of the spectrogram, a first message via the communication module.

22. The apparatus according to claim 21, wherein the devices uses, at least in part, a neural network to analyze the spectrogram.

* * * * *